US007131627B2

(12) United States Patent
Ward

(10) Patent No.: US 7,131,627 B2
(45) **Date of Patent: *Nov. 7, 2006**

(54) CONCRETE FORMING PANEL WITH FLEXIBLE BARRIER

(75) Inventor: Philip T. Ward, Leawood, KS (US)

(73) Assignee: Western Forms, Inc., Kansas City, MO (US)

( * ) Notice: Subject to any disclaimer, the term of this patent is extended or adjusted under 35 U.S.C. 154(b) by 87 days.

This patent is subject to a terminal disclaimer.

(21) Appl. No.: 10/678,378

(22) Filed: Oct. 2, 2003

(65) Prior Publication Data

US 2004/0084604 A1 May 6, 2004

Related U.S. Application Data

(63) Continuation of application No. 09/834,149, filed on Apr. 12, 2001, now Pat. No. 6,655,650.

(51) Int. Cl.
*E04G 9/00* (2006.01)

(52) U.S. Cl. ..... 249/189; 249/47; 249/18; 249/194; 249/210; 249/191; 52/742.1; 52/742.14

(58) Field of Classification Search ..... 249/189, 249/47, 18, 194, 210, 191, 44, 45, 192, 193; 52/742.14, 189, 47, 18, 194, 210, 191, 44, 52/45, 192, 193, 586.1; 220/681, 678
See application file for complete search history.

(56) References Cited

U.S. PATENT DOCUMENTS

| | | | | |
|---|---|---|---|---|
| 3,068,617 A | | 12/1962 | Borski | |
| 3,434,689 A | * | 3/1969 | Aftreth | 249/193 |
| 3,815,864 A | | 6/1974 | Loeber | |
| 3,822,858 A | | 7/1974 | Franklin | |
| 4,181,286 A | | 1/1980 | Van Doren | |
| 4,372,629 A | * | 2/1983 | Propst et al. | 312/223.6 |

(Continued)

FOREIGN PATENT DOCUMENTS

| | | |
|---|---|---|
| JP | 586671 | 4/1993 |

(Continued)

OTHER PUBLICATIONS

Western Forms, Inc. Catalog titled "World's Leading Innovator in Aluminum Forming Systems" copyright 1999, all pages.

(Continued)

*Primary Examiner*—Basil Katcheves
*Assistant Examiner*—Chi Q. Nguyen
(74) *Attorney, Agent, or Firm*—Hovey Williams LLP

(57) ABSTRACT

A forming panel and method for using the same in construction of self-sustaining concrete wall structures is provided wherein a flexible barrier element is provided along a margin on the forming panel for impeding the flow of water and fine particles of a concrete mix pour past the barrier element. The margin may be along the perimeter edge of the forming panel or along an opening interior to the perimeter of the forming panel. When located near the perimeter, the flexible barrier element may be positioned in a slot extending parallel to the margin and located in the frame. When located near an interior opening, the barrier element may be provided on a reinforcing member positioned around the opening or on a door which shifts to improve access through the opening during placement of forming ties or the like. The forming panel may be coupled with adjacent forming members to provide a wall system, and two wall systems may be connected by forming ties to provide a channel for receipt of a concrete pour therebetween.

6 Claims, 4 Drawing Sheets

U.S. PATENT DOCUMENTS

| | | | | | |
|---|---|---|---|---|---|
| 4,405,112 | A | | 9/1983 | Doubleday et al. | |
| 4,708,315 | A | | 11/1987 | Carlson et al. | |
| 4,744,541 | A | | 5/1988 | Carlson et al. | |
| 4,957,272 | A | | 9/1990 | Lee | |
| 4,958,800 | A | | 9/1990 | Carlson | |
| 4,976,401 | A | | 12/1990 | Carlson | |
| 4,978,099 | A | | 12/1990 | Carlson | |
| 5,044,601 | A | | 9/1991 | Miller | |
| 5,058,855 | A | | 10/1991 | Ward | |
| 5,080,321 | A | | 1/1992 | Carlson | |
| 5,083,740 | A | | 1/1992 | Sawyer et al. | |
| 5,090,710 | A | | 2/1992 | Flower | |
| 5,160,640 | A | | 11/1992 | Bedstieber | |
| 5,174,909 | A | | 12/1992 | Ward | |
| 5,176,389 | A | | 1/1993 | Noone et al. | |
| 5,184,439 | A | | 2/1993 | Ward | |
| 5,288,051 | A | | 2/1994 | Ward | |
| 5,450,970 | A | | 9/1995 | Mitchell | |
| 5,487,246 | A | * | 1/1996 | Hodges et al. | 52/220.7 |
| 5,671,488 | A | | 9/1997 | Greferath | |
| 5,792,552 | A | | 8/1998 | Langkamp et al. | |
| 5,836,126 | A | * | 11/1998 | Harkenrider et al. | 52/410 |
| 5,965,053 | A | | 10/1999 | Carlson | |
| 5,975,482 | A | | 11/1999 | Wu et al. | |
| 5,979,138 | A | | 11/1999 | Allen | |
| 6,400,048 | B1 | | 6/2002 | Nishimura et al. | |
| 6,419,204 | B1 | | 7/2002 | Flathau | |
| 6,502,802 | B1 | | 1/2003 | Jorn et al. | |
| 6,526,713 | B1 | * | 3/2003 | Moore, Jr. | 52/309.11 |
| 6,655,650 | B1 | * | 12/2003 | Ward | 249/189 |
| 2004/0035084 | A1 | * | 2/2004 | Ward | 52/742.14 |

FOREIGN PATENT DOCUMENTS

| | | |
|---|---|---|
| JP | 6288086 | 10/1994 |

OTHER PUBLICATIONS

Article title "Good forming details: a critical element in architectural concrete" from "Concrete Construction" Magazine, Nov. 1972.

Hard copies of screens from the following Felton Brush Web site addresses: http://www.feltonauto.com/currentapps.htm.

Hard copies of screens from the following Felton Brush Web site addresses: http://www.feltonauto.com/current_cups.htm.

Hard copies of screens from the following Felton Brush Web site addresses: http://www.feltonauto.com/current_pmdl.htm.

Brochure:: The World's Leading Innovator in Aluminum Forming Systems (Western Forms, Inc. 1993) (6 pages printed on front and back including cover).

Brochure: A New Generation in Aluminum Forming Systems (Western Forms, Inc. 1988) (6 pages printed on front and back including cover).

Bruchure: Concrete Forming Accessories, 2nd ed. (Western Forms, Inc. [before 1999]) (49 printed pages not including front/back cover, divider tabs and printing on inside of covers).

* cited by examiner

CONCRETE FORMING PANEL WITH FLEXIBLE BARRIER

RELATED APPLICATION

This application is a continuation of U.S. patent application Ser. No. 09/834,149 filed Apr. 12, 2001 now U.S. Pat. No. 6,655,650.

BACKGROUND OF THE INVENTION

1. Field of the Invention

The present invention broadly concerns a forming panel used in forming wall structures of hardenable concrete, whereby multiple panels may be placed in adjacency and in opposition for receiving and supporting the concrete pour therebetween. More particularly, it is concerned with a concrete forming panel which includes a flexible barrier positioned adjacent and preferably aligned with a margin on the forming panel such as a perimeter edge or on an interior edge to inhibit the flow of the concrete mix therepast.

2. Description of the Prior Art

The formation of building walls, foundations and other wall structures from poured concrete after curing is well known and the forms used for holding the concrete fall into two general categories. Forming walls may be made of site-built forms, typically of plywood, and are used only once before being discarded, or of reusable forming panels, typically of wood, steel or aluminum or combinations thereof, which panels may be fastened together and then removed from the hardened concrete wall for reuse. While these reusable forming panels are typically of a greater initial cost, their ability to be repeatedly used more than compensates for the initial expense.

The reusable forming panels typically have a face plate supported by a frame and are joined together in adjacency (essentially side-by-side or angled) to provide a form wall, and two form walls oppose one another to receive the concrete therebetween. Each forming panel may have a number of relieved areas along the side to receive tie bars for connecting the opposing form walls. Where the panels meet along their perimeters, small gaps are present, especially in the relieved areas not occupied by a tie bar. Moreover, the panels may have interior holes or openings which are penetrated interiorly of the perimeter of the forming panel by tie bars, rods or the like, and there are similar gaps between the tie bars and the surrounding forming panel. The concrete is mixed with water to make it flowable and ready to pour, the concrete mix typically including water, fine particles of mortar and sand, and aggregate such as gravel. In the gaps along the perimeter of the forming panels and where there are openings on the interior of the forming panel, water and fine particles of sand and mortar of the wet concrete will typically migrate from the concrete pour during curing. As a result, the appearance of the cured and hardened concrete opposite these gaps will be discolored, and will typically have significant raised ridges and be pitted rather than smooth as appears along the face of the forming panel. The large ridges and the pitted area along the face may affect not only the appearance but also the performance of the concrete wall over time.

SUMMARY OF THE INVENTION

These problems are significantly ameliorated by the concrete forming panel provided with a flexible barrier in accordance with the present invention. By the provision of a flexible barrier along and proximate to one or more margins in the forming panel which engage flowable concrete during curing, such as the face plate and frame, a substantial reduction in the loss of fine mortar particles and water is achieved. This results in a finished wall surface with substantial reduction of discoloration and pitting, even in the relieved tie bar passage area or interior openings. The flexible barrier serves as a gasket which yields for variations in the size of the gaps as well as permitting tie bars and other forming accessories to abut and pass thereby, and stands up to rugged use environments. Moreover, when the panel has an opening within the perimeter of the face plate and rails of the frame, by providing an interior margin provided with such a barrier within the perimeter of the forming panel, the forming panel hereof substantially reduces the problem of large ridges and pitting where tie bars and other forming hardware must pass through openings in the frame inside of the perimeter. An additional benefit is reduced seepage of moisture into and through the hardened wall structure.

In greater detail, the forming panel with flexible barrier along one or more of its margins broadly includes a form configured to receive a pour of a flowable concrete mix in supporting relationship thereagainst, the forming panel in a face plate typically of aluminum and a frame also of aluminum or steel having at least one siderail. The frame typically includes parallel and spaced apart, opposed endrails, siderails in spaced relationship and extending parallel thereto, and crossbraces, end reinforcements and gusset plates. The rails have exposed edges and face plate edges, with elongated grooves provided in the rails (both endrails and siderails) on the exterior side thereof. Flexible barriers acting as gaskets, preferably of filaments such as brush strips, are received in the grooves to impede the migration of water and fine particles of the concrete mix therepast as the barriers engage opposing parts of the forming panel or adjacent forming panels. The brush fibers of the brush strips are preferably oriented at an angle toward the concrete-receiving surface of the face plate and extend beyond the outer surface of the frame, whereby when the barrier is engaged by another component of the forming panel, a tie bar, another forming panel or an opposing barrier, the brush fibers project toward the concrete mix in the pour and the face plate rather than away to minimize the amount of water and fine mortar and sand particles of the mix carried into the gap between forms. Alternately, or in addition to the flexible barrier positioned near the perimeter margin of the forming panel, openings within the face plate may have flexible barriers mounted in proximity. The openings within the face plate may be substantially covered by a shiftable door which may be hinged, so that when there is no need to pass a tie bar therethrough, the door may be sealed. On the other hand, opening the door greatly facilitates placement and coupling of a tie bar to the forming panel, and closing of the door still permits a tie bar to pass thereby. The flexible barrier may be provided on either the door or a reinforcing enclosure around the opening, or both. The door is preferably hingably mounted to the reinforcing enclosure and a closure member provided to hold the door closed. A narrow gap may be provided between the door and the face plate when the door is in a closed position, to thereby permit the tie bar to pass therethrough when the door is closed, the barrier element helping to seal the gap.

As a result, forms are provided which substantially reduce the amount of discoloration and pitting in the finished wall surface, minimize the formation of ridges of material migrating into the gaps between forms, and provide an improved finished concrete surface while remaining rugged in use.

These and other advantages will be appreciated by those skilled in the art with reference to the drawings and description which follow.

DESCRIPTION OF THE PREFERRED EMBODIMENT

Figure 4:
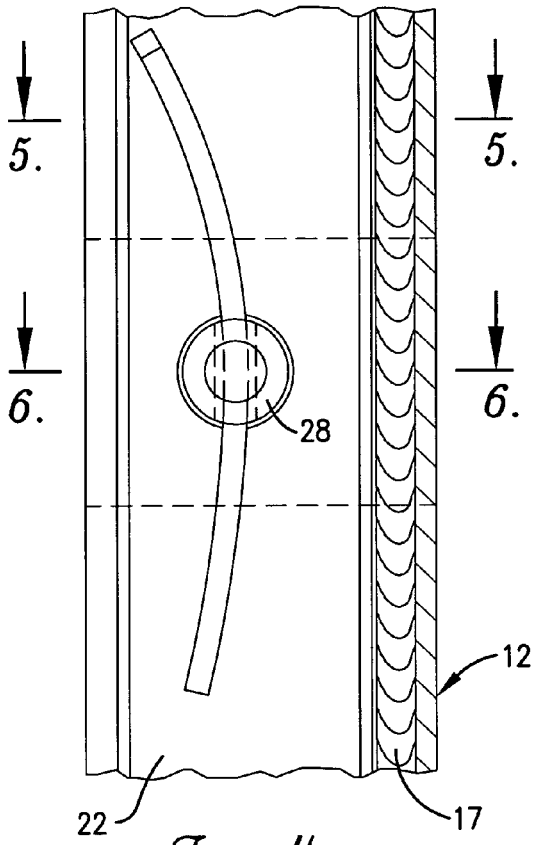
FIG. 4 is an enlarged, fragmentary vertical sectional view through a portion of the face plate and showing a coupler pin and wedge for holding together two forming panels in side by side relationship and with a tie bar shown in broken lines.
Figure 5:
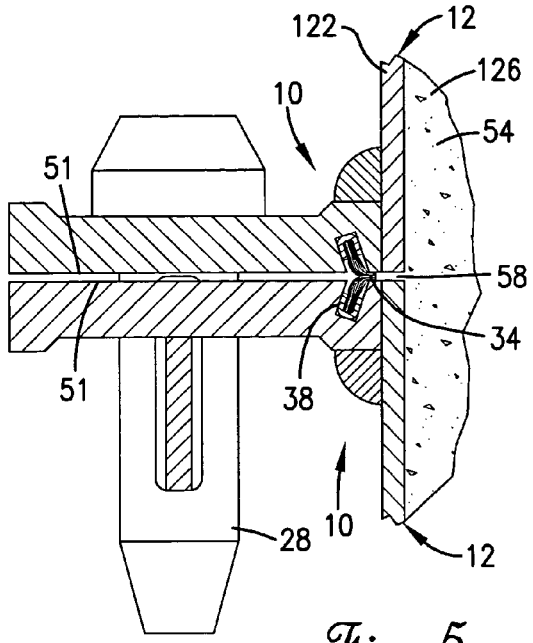
FIG. 5 is an enlarged, fragmentary cross-sectional view taken through line 5—5 of FIG. 4, showing the orientation of two opposed flexible barrier elements of adjacent forming panels extending into the gap therebetween.
Figure 6:
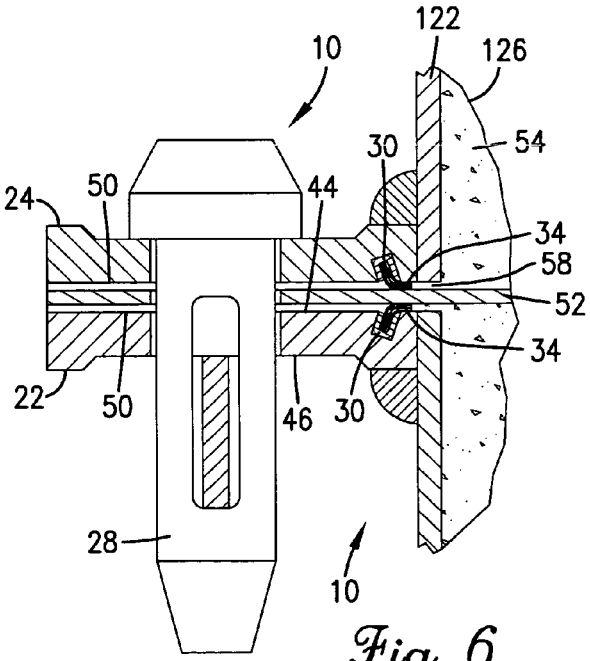
FIG. 6 is an enlarged, fragmentary cross-sectional view taken through line 6—6 of FIG. 4, showing the orientation of the two opposed flexible barrier elements when compressed by a tie bar received in the relieved area and passing through the gap.

Referring now to the drawing, a concrete forming panel 10 in accordance with the present invention broadly includes a face plate 12 typically of aluminum and a frame 14 mounted along the perimeter 15 of the forming panel 10, also preferably primarily of aluminum by welds 17. As used herein, "aluminum" refers to aluminum alloys, such as, for example, ASTM 6061 T-6 alloy, and the face plate, and a typical thickness of aluminum sheeting used as a face plate 12 would be about 0.125 inch. The frame 14 preferably includes a pair of elongated endrails 16 and 18 and a pair of opposed siderails 20 and 22, which in the illustrated embodiment the siderails are shown parallel to each other and perpendicular to the endrails, although it may be appreciated that it is possible for the forming panel to be in various geometries and have arcuate edges. A typical endrail or siderail of aluminum has a thickness of about ⅜ inch. The frame may include cross-braces 24, and end braces, gusset plates at the corners, and steel bushing plates or reinforcements to reinforce holes 26 spaced along the siderails 20 and 22 which receive therethrough coupler pins 28 secured by wedges as shown in FIGS. 4, 5 and 6, with such steel reinforcing members positioned adjacent the holes 26 for wear resistance. The face plate 12 lies in a plane and is shown flat and smooth, although textured surface face plates 12 may be used as well.

Figure 2:
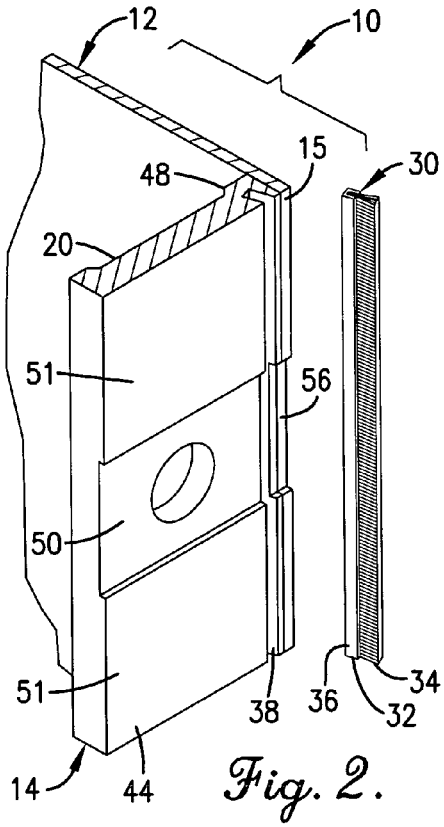
FIG. 2 is an enlarged, fragmentary perspective view showing a siderail and face plate in section and a relieved area for the passage of a tie bar, with the flexible barrier shown in an exploded view.
Figure 3:
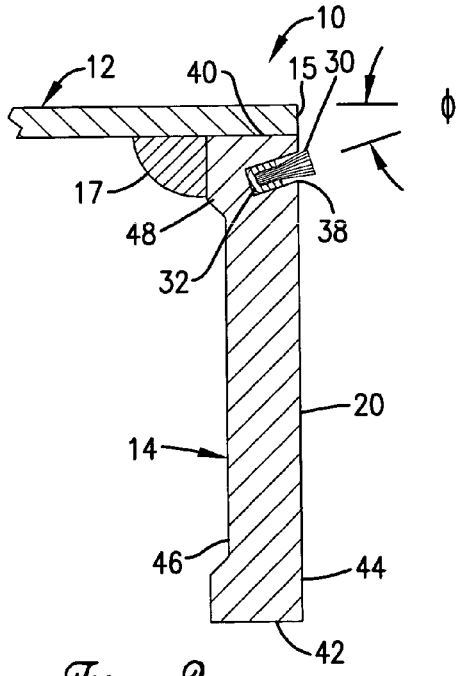
FIG. 3 is an enlarged fragmentary horizontal sectional view through a sidewall and the face plate showing the orientation of the tips of the fibers of the flexible barrier oriented at an acute angle to the plane in which the face plate lies.

A barrier element 30 of flexible material such as rubber or more preferably brush strips 32 of nylon fibers or bristles 34 secured by metal retaining clips 36 is received in longitudinally extending slots 38 in the siderails 20 and 22 and the endrails 16 and 18. The slots 38 are located more proximate the face plate edge 40 of the siderails and endrails than the back side exposed edge 42 of the siderails and endrails. The siderails and endrails each have an outer surface 44 and an inner surface 46, the slots 38 being in communication with the outer surface 44 as shown in FIGS. 2 and 3. The slots 38 are most preferably provided at an acute angle $\phi$ relative to the face plate 12 so that the bristles 34 extend forwardly toward the face plate edge 40 of the siderails and endrails. The bristles 34 are also of a sufficient length relative to the depth of the slots 38 that they project beyond the outer surface 44. The slots 38 are preferably positioned in a thickened region 48 of the siderails and endrails as shown in FIG. 3 in order to avoid weakening of the siderails and endrails.

Figure 7:
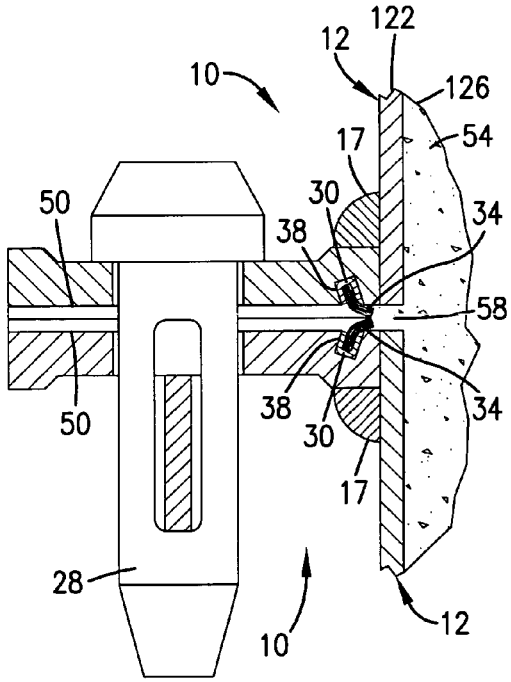
FIG. 7 is an enlarged, fragmentary cross-sectional view similar to FIG. 6, showing the relieved area adapted to receive the tie bar as in FIG. 6, but in the condition when a tie bar is not placed therethrough, with the flexible barrier elements engaging one another in the gap.
Figure 8:
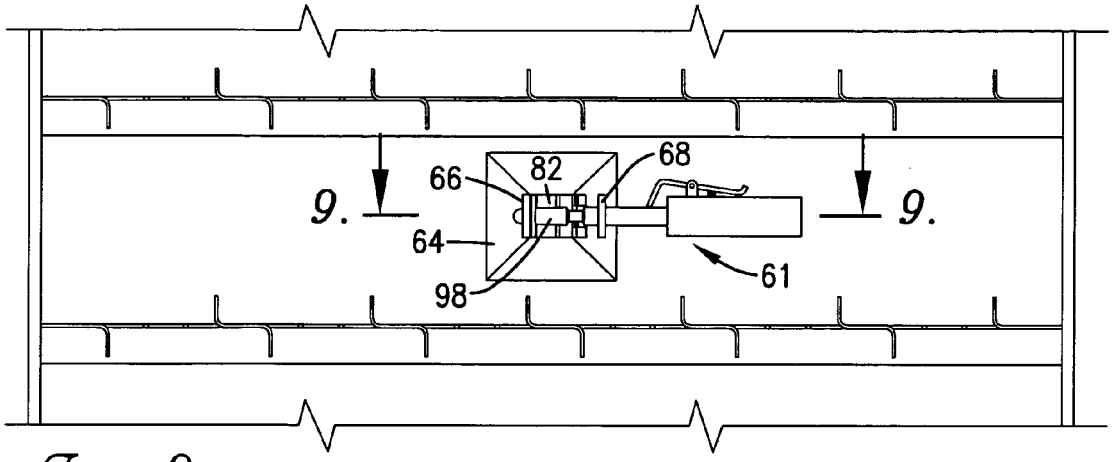
FIG. 8 is a rear elevational view of another aspect of the forming panel of FIG. 1, showing the portion of the forming panel which is provided with an opening in the face plate interior to the perimeter of the face plate and the side rails and end rails of the frame and having a reinforcing enclosure around the opening and a door for substantially closing the opening.

The siderails 20 and 22 are not of constant thickness along their longitudinal length, but rather their outer surface 44 is provided with longitudinally spaced, laterally extending relieved areas 50 adjacent unrelieved areas 51, the relieved areas 50 providing passages for tie bars 52 to be placed thereon and in the gaps between adjacent forming panels 10 as shown in FIGS. 6 and 7. The tie bars 52 are used to separate and hold at a predetermined distance an opposite forming wall of other forming members in order to provide a channel 126 therebetween for receipt of a pour of flowable concrete 54 therein. An adjacent relief 56 is also provided in the face plate 12 (see FIG. 2). As may be seen in comparing FIG. 5 showing two adjacent forming panels 10 in side-by-side relationship in cross-section taken through the siderails 20 and 22 of adjacent forming panels 10 with FIG. 6 taken in cross-section through the siderails 20 and 22 and the tie bar 52, the depth of the slots 38 are slightly less in the vicinity of the relieved areas 50 so that the tips of the barrier element fibers are substantially linear thus equidistant in a direction perpendicular from the outer surface 44 at the unrelieved areas 51 and exposing slightly more of the barrier element fibers in the relieved areas 50 than the unrelieved areas. Because the slots 38 are oriented on an axis that is at an acute angle $\phi$ relative to the plane in which the face sheet 12 lies, the resulting forward angled orientation of the bristles 34 toward the face plate 12, the engagement of opposed flexible barriers 30 with a tie bar 52 or with the barrier element 30 of an adjacent forming panel 10 causes the bristles 34 to slightly bend in a forward direction as shown in FIGS. 5 and 6. This in turn enhances the performance of the barrier element 30 by providing both a greater density of concentration of the bristles 34 where they interengage and also extending them forwardly to reduce the region into which water and particles from the concrete pour may migrate and lessen the extent of any ridge which may be formed as the concrete flows in to the gap 58 between the adjacent forms 10. As shown in FIG. 7, the bristles 34 of the barrier elements 30 are particularly helpful where there is no tie bar 52 positioned in a relieved area 50, which would otherwise present an even wider opening between the adjacent forming panels 10. The barrier elements 30 are preferably mounted all around the forming panel 10 on each of the rails in an orientation parallel to and closely adjacent the perimeter of the face plate 12.

FIGS. 1 and 8–11 illustrate an alternate embodiment where, in addition or as an alternative to the flexible barrier element 30 provided in the frame 14 around the perimeter of the forming panel 10, an opening 60 is provided in the face plate 12 inside the frame 14 and thus interiorly of the perimeter. A closure and support element 61 is attached to the face plate 12 adjacent the opening, shown as a reinforcing enclosure 62 of aluminum which surrounds and thus reinforces the opening and is attached to the face plate 12 or the cross members by welding, fasteners or the like. The enclosure 62 includes a base 64 which mounts to the face plate 12 by welding or the like to support and reinforce the face plate 12 surrounding the opening 60 and two spaced-apart gates 66 and 68, each having a respective passage 70 and 72 therethrough. A reinforcing rod 74 of hard steel, such as ASTM 228-93 wire, is received in a groove 76 adjacent the passages 70 and 72 and the deformation of the aluminum alloy caused by drilling the passages serves to pinch or hold the rod 74 in place. The reinforcing rod 74 helps to resist wear on the gates 66 and 68 and prevent enlargement of the passages. The base 64 may include a slot 78 adjacent to and facing the opening for receipt of a flexible barrier element 30 therein. Again, the flexible barrier elements may be rubber or more preferably brush strips 32 of nylon bristles 34 held by metal clips.

Figure 9:
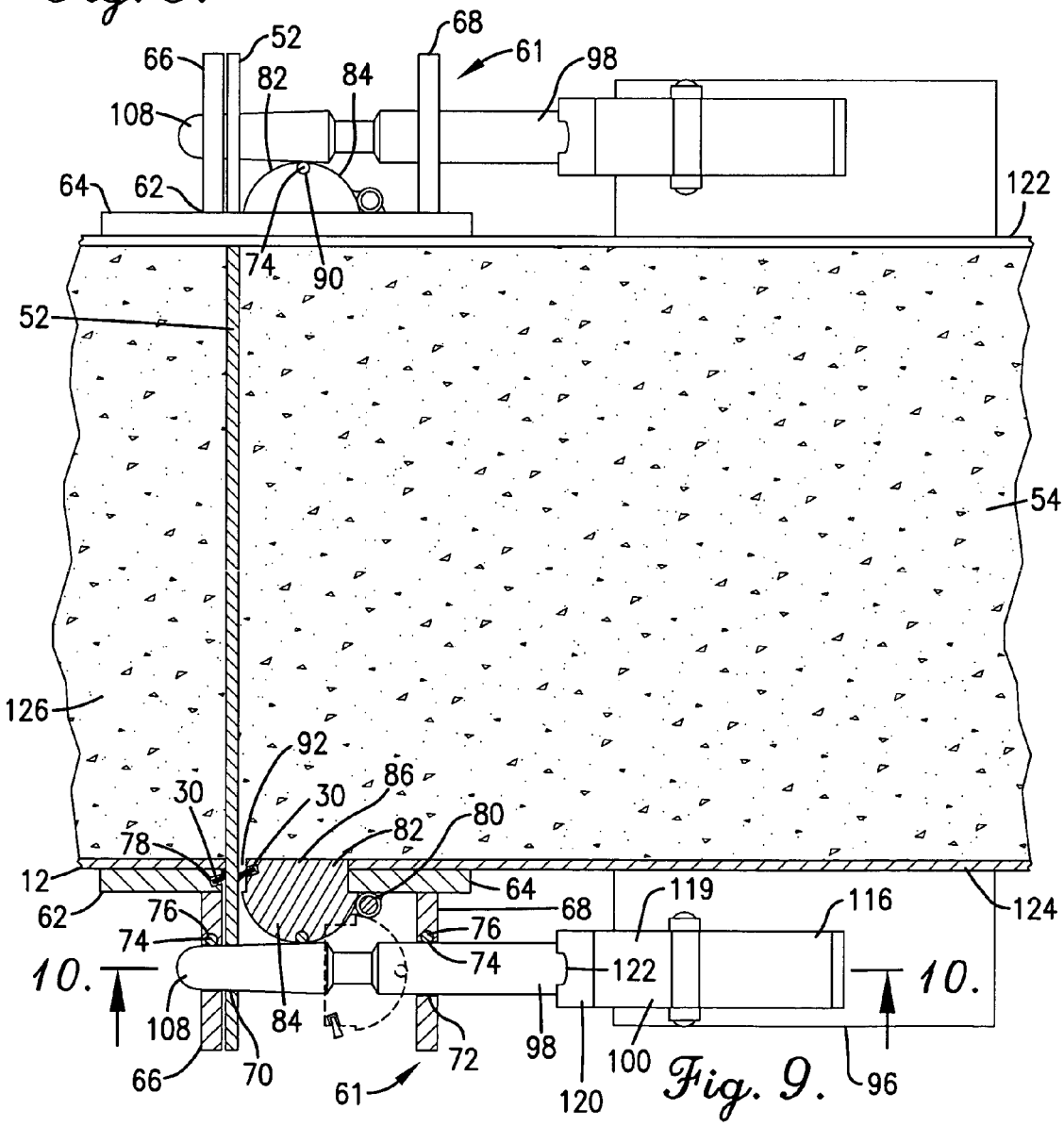
FIG. 9 is an enlarged, fragmentary cross-sectional view taken along line 9—9 of FIG. 8, showing two opposed forming panels of opposite forming walls positioned and connected by a tie bar for receiving flowable concrete in the channel therebetween, one of the panels being shown in plan, and the tie bar passing between the forming panels through the opening and a barrier element in both the enclosure and the door of the forming panels.

A hinge 80 is provided on the base 64 for pivotally mounting a door 82. As illustrated by FIG. 9, the door 82 may swing between a first position substantially but not completely closing the opening 60 and a second position which is open. The door 82 includes a head 84 and an insert 86 which fits within the opening 60. The head 84 presents a lip 88 which engages the base 64 and has a reinforcing rod 74 received in a groove 90 therein. The head 84 is sized to provide a slot 92 between the head 84 and the base 64 to permit passage of a tie bar 52.

Figure 10:
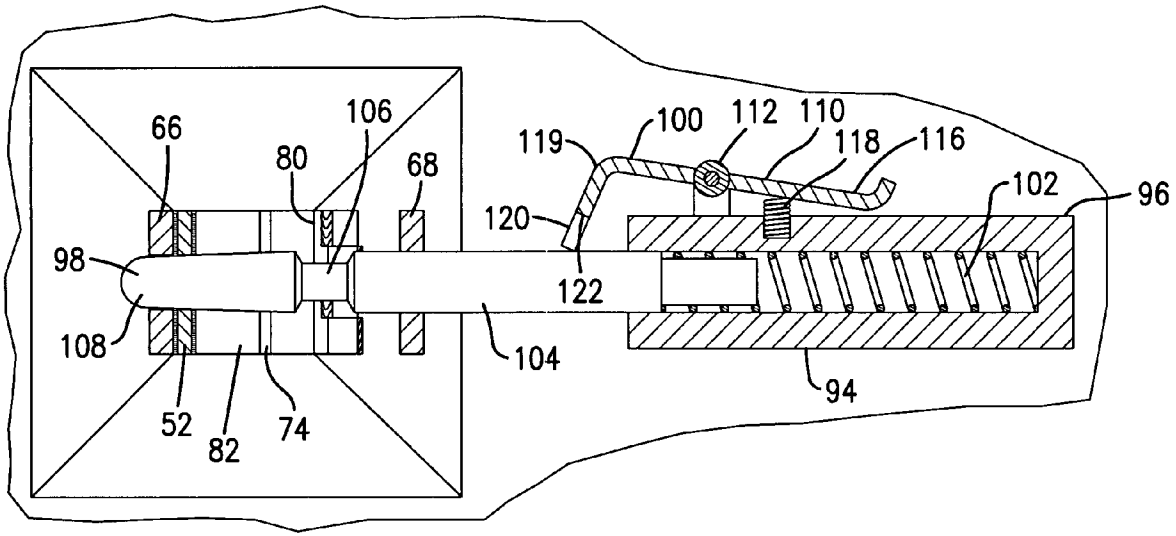
FIG. 10 is an enlarged, fragmentary elevational view in partial cross-section along line 10—10 of FIG. 9, showing the combination pin fastener and door retainer in a first position holding the door closed and passing through a hole in the tie bar.
Figure 11:
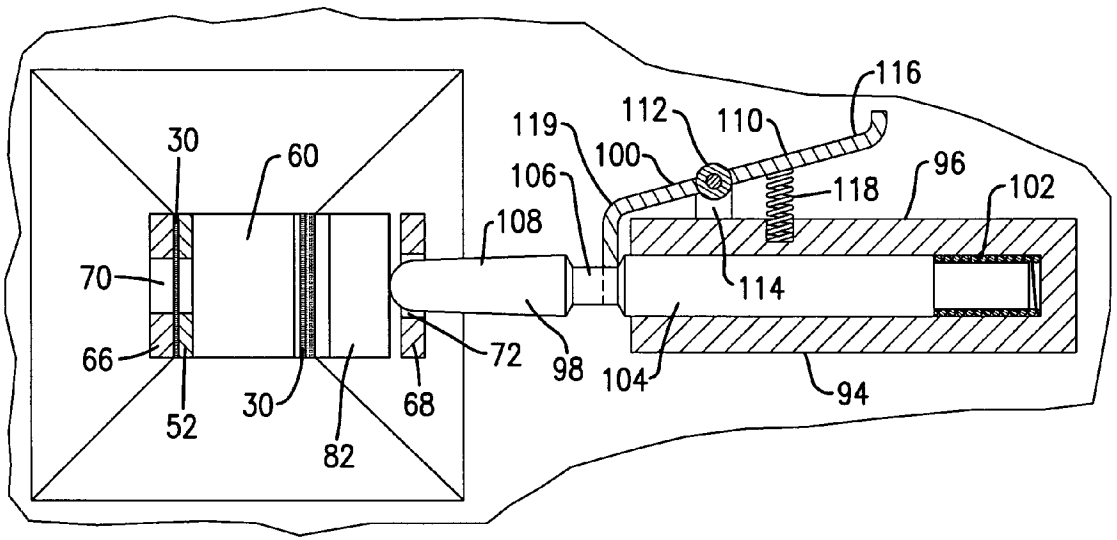
FIG. 11 is an enlarged, fragmentary elevational view in partial cross-section as in FIG. 10, but with the combination pin fastener and door retainer retracted and retained in a second position where the hinged door is open to facilitate insertion of the tie bar or removal of the forming panel.

The door 82 is held closed by closure mechanism 94. The closure mechanism 94 is mounted on arm welded to the face plate 12 or to a cross-brace 24 of frame 14. The closure mechanism 94 includes a housing 96, a pin 98 shiftably received in the housing 96, and a catch 100. As illustrated in FIGS. 10 and 11, the pin 98 is biased toward the gate 66 by a coil spring 102 received within the housing. The pin 98 includes a shank 104 slidable within the housing 96, a narrowed neck 106, and a nose 108 which is rounded at its tip. Both the nose 108 and the shank 104 have a greater diameter than the diameter of the neck 106. The catch 100 includes a bar 110 which is mounted by a hinge 112 for toggling on pivot mount 114. The bar 110 has a first end 116 which is engaged on its underside by a spring 118 extending from the housing 96 and a second end 119 which has a cradle 120 which includes an arcuate web 122 sized to receive the neck 106 but not the shank 104 therein. Thus, the spring 118 biases the cradle 120 toward the pin 98.

Figure 1:
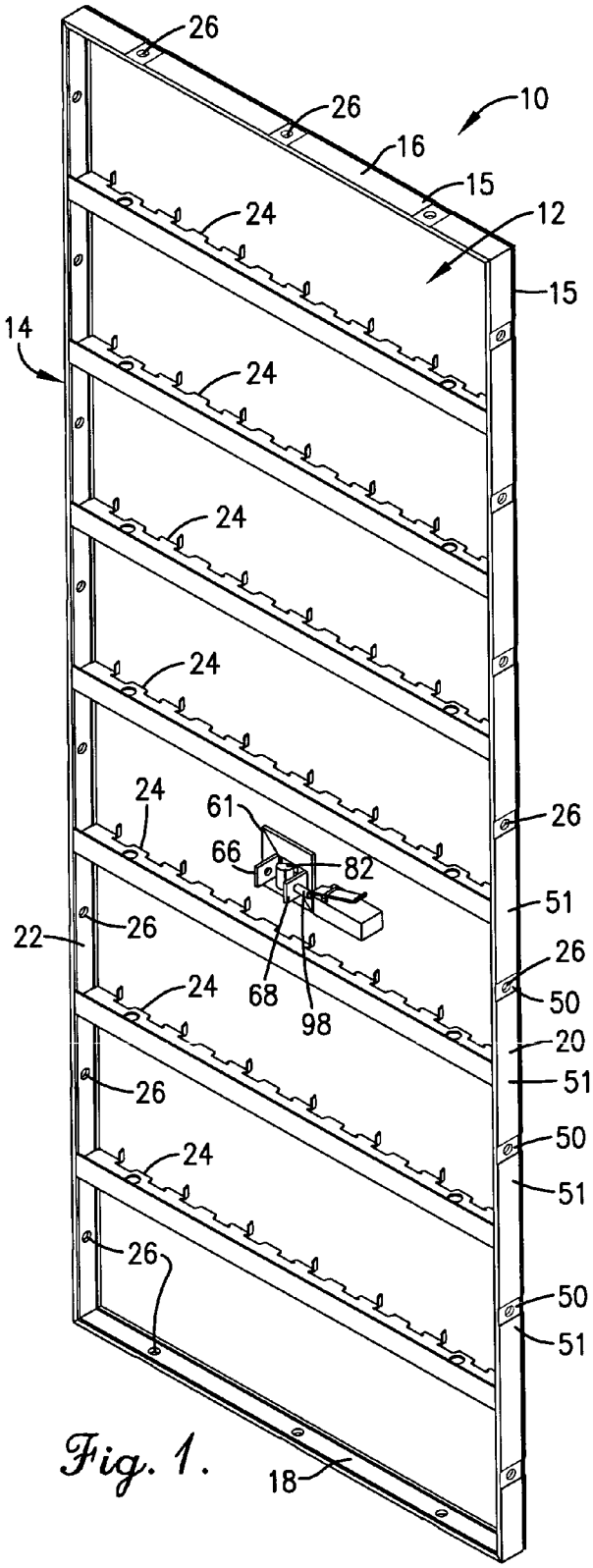
FIG. 1 is a rear perspective view of a concrete forming panel in accordance with the present invention, showing the face plate and the frame, with a flexible barrier extending around the siderails and endrails of the frame parallel to and adjacent the perimeter of the forming panel.

In use, the forming panel 10, shown individually in FIG. 1, is coupled to adjacent forming members, such as another forming panel 10 as shown in FIGS. 5, 6 and 7, to provide one forming wall 122, and another forming wall 124 is positioned opposite as shown in FIG. 9 so that a channel 126 for receiving flowable concrete 54 is therebetween. Tie bars 52 are placed in at least some of the relieved areas 50, though typically not all of them and extend through the channel to connect the forming walls 122 and 124 when connected to the forming panels by pins 28. Adjacent forming panels are connected by pins 28 held in place by wedges as shown in FIGS. 4, 5, 6 and 7, with these pins 28 passing through holes in the tie bars 52 to hold them in position. The tie bars extend across and through the channel 126 for connecting the opposing forming walls 122 and 124, whereby after the concrete 54 cures, the tie bars 52 remain embedded in the concrete wall structure formed thereby.

In addition, door 82 may swing open to facilitate positioning of a tie bar 52 through the opening 60 in opposing forming panels 10. The pin 98 is first retracted against the coil spring 102 and the catch is released whereby the web 122 of the cradle 120 rests around the neck 106 and against the shank 104 to hold the pin 98 in a retracted position. The tie bar 52 is then aligned to lie closely adjacent the gate 66, whereupon the door may be closed to substantially block the opening 60. With the door closed, the operator presses on the first end 116 of the catch 100 to release the spring loaded pin 98. The pin 98 then passes through the hole of the tie bar 52 and through the gate 66 to both hold the door 82 in the closed position and secure the forming panel 10 to the tie bar 52. Thereafter, dry concrete mixed with water may be poured into the channel 126, which after a suitable curing period, hardens. The barrier elements 30 substantially inhibit the flow of water and fine particles of mortar, sand and the like from the concrete 54 while it cures. The barrier elements 30 along the side rail and end rail edges oppose one another as shown in FIG. 5 to inhibit substantial flowing of material without inhibiting the performance or coupling ability of the forming panels. The bristles 34 yield when engaged by tie bars 52 or the frame 14 and being separate, resist tearing, while providing a substantial barrier to the flow of water and fine particles from the concrete. The flexible barrier elements are especially beneficial in resisting flow of water and fine particles both when a tie bar 52 is present in a relieved area 50 or, even more importantly, when a tie bar 52 is not used in a relieved area as shown in FIG. 7. When an opening 60 is provided in the forming panel interiorly of the perimeter provided by the frame, the door 82 is able to swing open to ease the placement of the tie bar. After the tie bar 52 is in place, the door may be closed to inhibit the flow of concrete or the water and fine particles thereof through the opening 60. The flexible barrier elements 30 in the base 64 and the door 82 further limit the migration of water and fine particles through the slot 92. The first end 116 of the bar 110 is depressed to release the cradle, whereupon the coil spring 102 pushes the pin 98 through the gate 66 so that the nose of the pin 98 rests against the head of the door 82 to hold the door in a closed position.

After the concrete 54 cures and hardens, the forming panels 10 may be readily removed for reuse by removing the wedges from the coupler pins 28 and pulling the coupler pins through the holes 26 in the rails. The pin 98 is retracted so that the cradle engages the neck of the pin 98 to permit opening of the door 82. This also disengages the pin 98 from the tie bar 52, permitting the forming panels 10 to be removed. The barrier elements 30 substantially limit the migration of water and fine particles from the concrete 54 as it hardens and thus inhibits the formation of substantial ridges opposite the gaps between forming panels. A smoother surface of the resulting wall with substantially less pitting results from the use of the barrier elements both around the perimeter edge of the forming panels 10 and at any interior openings.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. A concrete forming panel for use in construction of a self-sustaining concrete structure from a concrete mix containing flowable constituents which are capable of migrating from a concrete pour during curing of the mix, said forming panel comprising:

a load-bearing face plate having a front face that faces in a forward direction and is adapted to receive at least a part of the concrete pour thereagainst during curing of the mix;

structure projecting in an opposite, rearward direction from said face plate; and a flexible barrier element mounted on said structure in spaced relationship to said front face and adapted for impeding migration of the constituents out of the pour past the barrier element until the concrete mix has cured, said face plate having an outer edge margin, said structure being located adjacent said outer edge margin and including part of a frame upon which said face plate is mounted, said face plate having an opening disposed inwardly from said outer edge margin, said structure further including a support that positions said barrier element adjacent said opening, further comprising a door swingably mounted on said support for movement between open and closed positions relative to said opening, said barrier element being disposed to cooperate with said door in sealing said opening when the door is in said closed position yet permit the presence of a tie bar in said opening.

2. A concrete forming panel for use in construction of a self-sustaining concrete structure from a concrete mix containing flowable constituents which are capable of migrating from a concrete pour during curing of the mix, said forming panel comprising:

a load-bearing face plate having a front face that faces in a forward direction and is adapted to receive at least a part of the concrete pour thereagainst during curing of the mix;

structure projecting in an opposite, rearward direction from said face plate; and a flexible barrier element mounted on said structure in spaced relationship to said front face and adapted for impeding migration of the constituents out of the pour past the barrier element until the concrete mix has cured, said face plate having an opening disposed inwardly from an outer edge margin of the face plate, said structure including a support that positions said barrier element adjacent said opening, further comprising a door swingably mounted on said support for movement between open and closed positions relative to said opening, said barrier element being disposed to cooperate with said door in sealing said opening when the door is in said closed position yet permit the presence of a tie bar in said opening.

3. A concrete forming panel for use in construction of a self-sustaining concrete structure from a concrete mix containing flowable constituents which are capable of migrating from a concrete pour during curing of the mix, said forming panel comprising:

a load-bearing face plate having a front face that faces in a forward direction and is adapted to receive at least a part of the concrete pour thereagainst during curing of the mix;

structure projecting in an opposite, rearward direction from said face plate; and a flexible barrier element mounted on and supported solely by said structure of the same panel in spaced relationship to said front face and capable of and disposed for impeding migration of the constituents out of the pour past the barrier element until the concrete mix has cured, said face plate having an outer edge margin, said barrier element being located adjacent to and extending along said outer edge margin, said structure having an elongated retaining slot within which the barrier element is received, said slot being disposed at an acute angle relative to said front face such that the barrier element projects generally toward the front face at an acute angle relative thereto.

4. A forming panel as claimed in claim 3, said barrier element comprising a brush strip having bristles.

5. A concrete forming panel assembly for use in construction of a self-sustaining concrete structure from a concrete mix containing flowable constituents which are capable of migrating from a concrete pour during curing of the mix, said panel assembly comprising:

a forming panel; and a brush strip mounted on said panel in such a position that bristles of the brush strip are disposed for impeding migration of the constituents out of the pour when the panel assembly is in use, said forming panel having an opening disposed inwardly from an outer edge margin of the forming panel, said brush strip being mounted on a support that positions said brush strip adjacent said opening, further comprising a door swingably mounted on said support for movement between open and closed positions relative to said opening, said brush strip being disposed to cooperate with said door in sealing said opening when the door is in said closed position yet permit the presence of a tie bar in said opening.

6. A concrete forming panel assembly for use in construction of a self-sustaining concrete structure from a concrete mix containing flowable constituents which are capable of migrating from a concrete pour during curing of the mix, said panel assembly comprising:

a forming panel; and a brush strip mounted on said panel in such a position that bristles of the brush strip are disposed for impeding migration of the constituents out of the pour when the panel assembly is in use, said forming panel including a face plate and a frame secured to and projecting rearwardly from said face plate, said frame including a frame member at an outer margin of the face plate, said brush strip being mounted on said frame member at a location spaced rearwardly from a front surface of the face plate, said frame member having an elongated slot that receives said brush strip, said slot being disposed at an acute angle relative to said front face such that the brush strip projects generally toward the front face at an acute angle relative thereto.

* * * * *